US009840399B2

(12) United States Patent
Cao et al.

(10) Patent No.: US 9,840,399 B2
(45) Date of Patent: Dec. 12, 2017

(54) MINING ELEVATOR CARRYING PLATFORM AND CARRYING METHOD

(71) Applicants: China University of Mining and Technology, Xuzhou (CN); Dongnan Elevator Co. Ltd., Suzhou (CN)

(72) Inventors: Guohua Cao, Xuzhou (CN); Zhencai Zhu, Xuzhou (CN); Jiancong Qin, Xuzhou (CN); Hongqiao Kang, Xuzhou (CN); Gongbo Zhou, Xuzhou (CN); Wei Li, Xuzhou (CN); Guoan Chen, Xuzhou (CN); Renyuan Wu, Xuzhou (CN); Jianrong Yang, Xuzhou (CN); Yiping Ma, Xuzhou (CN)

(73) Assignees: China University of Mining & Technology, Jiangsu (CN); Dongnan Elevator Co. Ltd., Jiangsu (CN)

( * ) Notice: Subject to any disclaimer, the term of this patent is extended or adjusted under 35 U.S.C. 154(b) by 605 days.

(21) Appl. No.: 14/383,751

(22) PCT Filed: Mar. 25, 2013

(86) PCT No.: PCT/CN2013/073106
§ 371 (c)(1),
(2) Date: Sep. 8, 2014

(87) PCT Pub. No.: WO2013/143424
PCT Pub. Date: Oct. 3, 2013

(65) Prior Publication Data

US 2015/0096842 A1 Apr. 9, 2015

(30) Foreign Application Priority Data

Mar. 27, 2012 (CN) ..... 2012 1 0083200

(51) Int. Cl.
*B66B 17/18* (2006.01)

(52) U.S. Cl.
CPC ..... *B66B 17/18* (2013.01)

(58) Field of Classification Search
CPC ..... B66B 17/18
See application file for complete search history.

(56) References Cited

U.S. PATENT DOCUMENTS 1,051,945 A * 2/1913 Baumann et al. .... B66B 13/301 187/400
1,572,202 A * 2/1926 Goulet ..... B66B 17/18 187/400

(Continued)

FOREIGN PATENT DOCUMENTS

CN 2778775 5/2006
CN 102602789 7/2012

(Continued)

OTHER PUBLICATIONS

International Search Report re PCT/CN2013/073106, dated Jun. 27, 2013, 4 pgs.

*Primary Examiner* — Minh Truong
(74) *Attorney, Agent, or Firm* — Greenberg Traurig, LLP

(57) ABSTRACT

A mining elevator carrying platform and carrying method, the platform comprises a power system (1) and a four-rod carrying device (5), a rotating rod (3) connected with the power system (1) is set on the carrying device (5); the power system (1) comprises a flameproof motor (1-1), a upper-limited switch (1-2), a down-limited switch (1-5) and a main pulley (1-6), the flameproof motor (1-1) is connected with the main pulley (1-6) through a main steel cable (1-4), a baffle (1-3) is set on the main steel cable (1-4), a double cable channel is set on the main pulley (1-6), and the main pulley (1-6) is connected with a sub-pulley (1-8) by a sub-steel cable (1-7), a sliding plate (1-9) is set on the sub-steel cable (1-7), and a sliding rod (1-10) is set on the sliding plate (1-9). The main pulley (1-6) is driven to rotate (Continued)

by the flameproof motor (1-1) through the main steel cable (1-4), thus the sub-pulley (1-8) is driven to rotate. The sliding rod (1-10) moves in a strip-opening sliding slot in the rotating rod (3) by the sliding plate (1-9) moving up and down, then the rotating rod (3) and a carrying plate (5-1) are driven to move circumferentially. A rocker (5-3) is rotated around a supporting bracket (5-4) driven by a connecting rod (5-2), thus a credible carrying platform in multi-plane is realized. The platform is simple in structure, controlled accurately, convenient to be fixed and maintained, operated stably and reliably, and has the self-locking function.

3 Claims, 3 Drawing Sheets

(56) References Cited

U.S. PATENT DOCUMENTS 1,955,586 A * 4/1934 Hott ..... B66F 7/28
187/217
2,739,354 A * 3/1956 Pope ..... B66B 17/18
187/334
2,924,859 A * 2/1960 Alexander ..... B66B 17/18
187/400
4,420,286 A * 12/1983 Hanson ..... A61G 3/06
414/539
4,534,450 A * 8/1985 Savaria ..... B66F 7/0641
414/546
4,579,503 A * 4/1986 Disque ..... B60P 1/445
414/546
5,601,157 A 2/1997 Barth
7,326,024 B2 * 2/2008 Cohn ..... B60P 1/4457
414/546

FOREIGN PATENT DOCUMENTS

| | | |
|---|---|---|
| CN | 202670975 | 1/2013 |
| FR | 2374252 | 7/1978 |
| GB | 969610 | 9/1964 |

* cited by examiner

MINING ELEVATOR CARRYING PLATFORM AND CARRYING METHOD

TECHNICAL FIELD

The present invention relates to a mining elevator carrying platform and a carrying method, which are especially suitable for a mining elevator with a flexible guide rail as well as lapping of a common platform, provide safety protection and facilitate load transport into and out of the elevator, and ensure that the doorsill size of mining elevator complies with the safety standard for elevators.

BACKGROUND

Along with the high speed constant development of Chinese economic construction and the progress of mining machinery and elevator technology, mining elevator, as a product developed from the combination of mining lifter and elevator, has been introduced as a new user-friendly lifting apparatus into mine lifting systems. A mining elevator is a new mine lifting apparatus which is developed on the basis of conventional traction elevator and winch cage, by introducing elevator technology into mine lifting systems, employs a special steel cable as the guide rail, and transports persons and goods between the underground and the ground circularly. The mining elevator has significantly improved lifting efficiency, but the requirements for safe and reliability are much higher. At present, an elevator usually employs a rigid guide rail in close contact with a guide shoe to ensure the clearance between the ground sill and the landing door meets the requirement (30 mm) specified in the safety standard for elevators. However, in the harsh environment in a mine, the guide rail may incline, distort, tilt, or locally bulge, resulting in potential risks, for example, the elevator car is stuck in the rail; in addition, the strength of shaft wall and the construction conditions can not be satisfied. Therefore, a steel cable with higher rigidity is used as a flexible guide rail, so that appropriate safety distance can be provided between the elevator car and the landing platform; thus, a carrying device is required to connect the elevator car to the landing platform, to meet the safety standard for elevators. The existing carrying devices used in mine lifting system, such as cage seat, bridle, cradle, and cage supporter, etc., don't meet the requirement for multi-platform connection and are not suitable for multi-platform connection of a mining elevator with a flexible guide rail.

DETAILED DESCRIPTION

Figure 1:
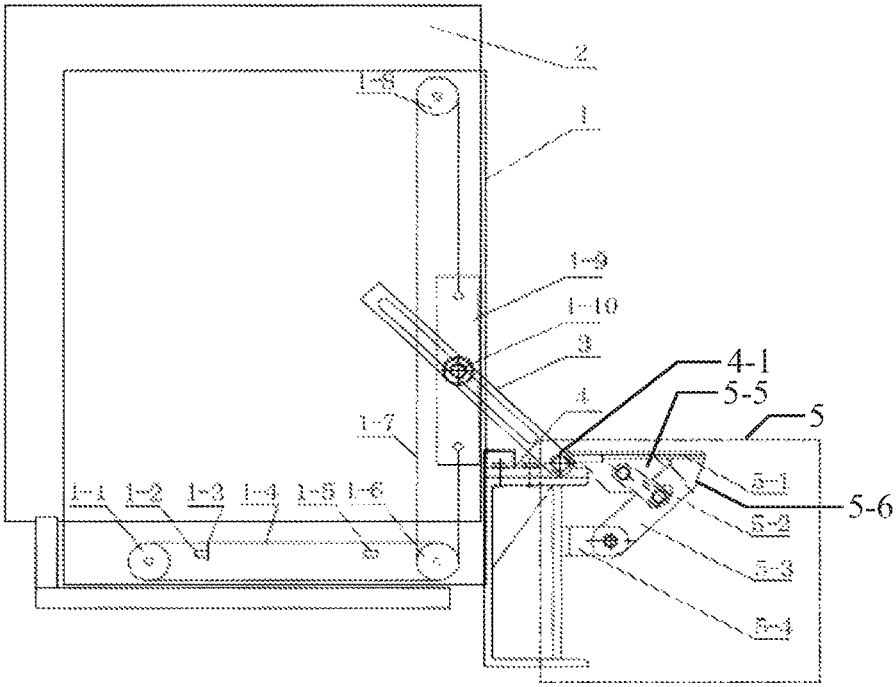
FIG. 1 is a side view of the mining elevator carrying platform in the present invention.

To overcome the drawbacks in the prior art, the present invention provides a mining elevator carrying platform, which has advantages such as simple structure, high safety, high action accuracy, and easy operation; in addition, the present invention provides a carrying method.

The mining elevator carrying platform in the present invention comprises a power system fixed to an elevator car and a four-rod carrying device, a rotating rod connected with the power system is arranged on the carrying device; the power system comprises an explosion-proof motor, an upper limit switch, a lower limit switch, and a main pulley that are fixed to a bottom beam of the elevator car in sequence, the explosion-proof motor is connected with the main pulley via a main steel cable wound on the explosion-proof motor, a stop plate is arranged on the main steel cable, the main pulley has a double cable channel, and is connected with a sub-pulley fixed to a side beam of the elevator car via a sub-steel cable, a sliding plate is arranged on the sub-steel cable, and a sliding rod designed to fix the rotating rod is arranged on the sliding plate; the carrying device comprises a supporting bracket fixed to a ground sill support of the elevator car, a carrying board rotates around a rotating shaft of the ground sill support, a rocker connected with the supporting bracket is provided on the lower part of the carrying board, and a connecting rod connected with the carrying board is provided on the rocker.

The rotating rod has a strip-opening sliding slot fitted over the sliding rod in its middle part; strengthening ribs are provided under the carrying board, and a supporting plate rib supported on the rocker is provided on the outer end of the carrying board.

The carrying method for the mining elevator carrying platform in the present invention is characterized in:

when the elevator car lands, the explosion-proof motor drives the main steel cable, the main steel cable drives the main pulley to rotate, and the sub-steel cable wound on the main pulley drives the sub-pulley to rotate at the same time, the sliding plate moves up and down so that the sliding rod moves in the strip-opening sliding slot of the rotating rod, and thereby the rotating rod and the carrying board are driven to move circularly, and the connecting rod drives the rocker to rotate around the supporting bracket;

when the stop plate on the main steel cable hits the upper limit switch, the explosion-proof motor stops, the end face of the rocker abuts against the end face of the supporting plate rib on the carrying board, and the carrying board reaches a preset position and self-locks, so that the persons and goods can enter or exit the elevator car via the carrying board;

when the landing door and elevator car door are closed, the explosion-proof motor drives the main steel cable and thereby drives the main pulley to rotate in reverse direction, and, when the stop plate hits the lower limit switch, the explosion-proof motor stops, and the carrying board is retracted and reset.

With the technical scheme described above, the carrying platform and carrying method can achieve reliable carrying of the lapping platform at multiple horizontal planes, accomplish safe transport of the load into and out of the elevator car, and ensure that the mining elevator complies with the safety standard for elevators in terms of the structure of landing door and elevator door; thus, the load can be transported into and out of the elevator car more safely and reliably; the carrying platform is simple in structure, can be controlled accurately, is easy and convenient to install and maintain, and operates stably. The advantages include:

(1) A platform can be connected to corresponding working plane at different heights, the elevator car lapping platform can be connected reliably at multiple horizontal working planes, and the initial investment at each horizontal working plane can be reduced;

(2) The carrying device employs a four-rod structure and has self-locking function; thus, the load can be transported into and out of the elevator car more safely and reliably;

(3) The power system employs a steel cable for traction; thus, the arrangement is convenient, the structure is simple, and the carrying platform can be lapped and retracted easily and conveniently;

(4) The control is accurate, the installation and maintenance is convenient, and the operation is stable; thus, the elevator operates more safely and reliably.

Hereunder the embodiments of the present invention will be described with reference to the accompanying drawings:

As shown in FIG. 1, the carrying platform in the present invention comprises a power system 1 fixed to an elevator car 2 and a four-rod carrying device 5, wherein, a rotating rod 3 connected with the power system 1 is arranged on the carrying device 5, the rotating rod 3 has a strip-opening sliding slot, and a sliding rod 1-10 is connected in the strip-opening sliding slot.

Figure 2:
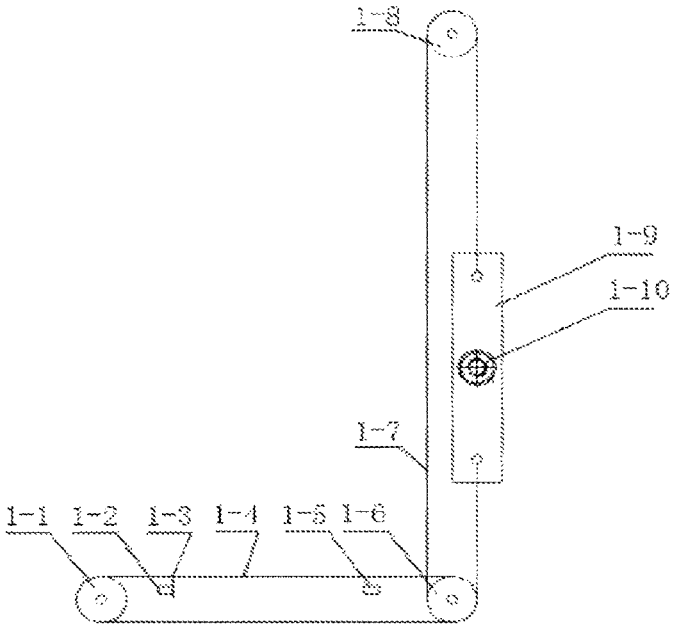
FIG. 2 is a schematic diagram of the power system in the mining elevator carrying platform in the present invention.

As shown in FIG. 2, the power system 1 comprises an explosion-proof motor 1-1, an upper limit switch 1-2, a lower limit switch 1-5, and a main pulley 1-6 that are fixed to a bottom beam of the elevator car 2 in sequence, wherein, the explosion-proof motor 1-1 is connected with the main pulley 1-6 via the main steel cable 1-4 wound on the explosion-proof motor 1-1, a stop plate 1-3 is arranged on the main steel cable 1-4, the main pulley 1-6 has a double cable channel, and is connected with a sub-pulley 1-8 fixed to a side beam of the elevator car 2 via a sub-steel cable 1-7, a sliding plate 1-9 is arranged on the sub-steel cable 1-7, and a sliding rod 1-10 designed to fix the rotating rod 3 is arranged on the sliding plate 1-9.

Figure 3:
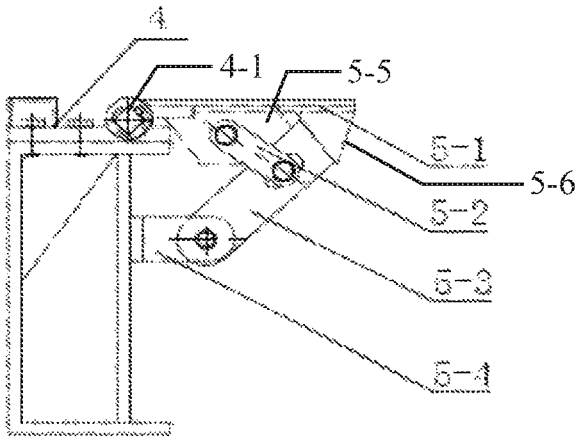
FIG. 3 is a schematic diagram of the carrying device in the mining elevator carrying platform in the present invention.

As shown in FIG. 3, the carrying device comprises a supporting bracket 5-4 fixed to a ground sill support 4 of the elevator car 2, a carrying board 5-1 that is fixedly connected to the rotating rod 3 and can rotated around a rotating shaft 4-1 of the ground sill support 4, a rocker 5-3 connected with the supporting bracket 5-4 is provided on the lower part of the carrying board 5-1, and a connecting rod 5-2 connected with the carrying board 5-1 is provided on the rocker 5-3.

Strengthening ribs 5-5 are provided under the carrying board 5-1 and a supporting plate rib 5-6 supported on the rocker 5-3 is provided on the outer end of the carrying board 5-1; in carrying state, the end face of the supporting plate rib 5-6 on the carrying board 5-1 abuts against the end face of the rocker 5-3; in this embodiment, three connecting rods 5-2, three rockers 5-3, and three supporting brackets 5-4 are provided, and are parallel to each other.

Figure 4:
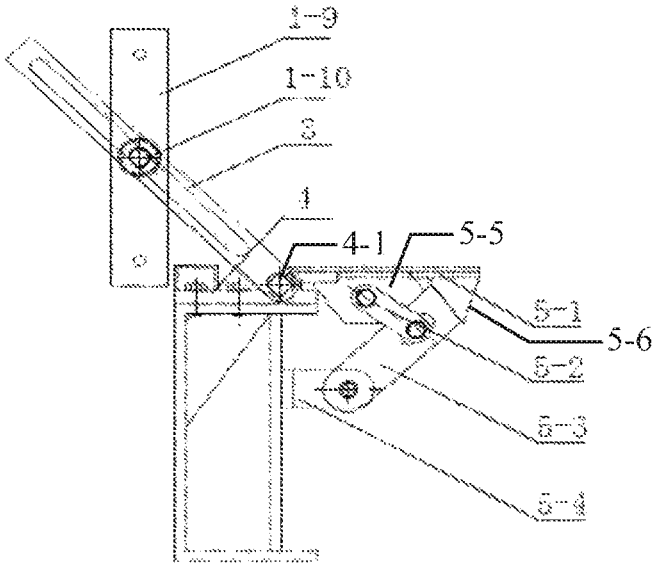
FIG. 4 is a side view of the mining elevator carrying platform in carrying state in the present invention.
Figure 5:
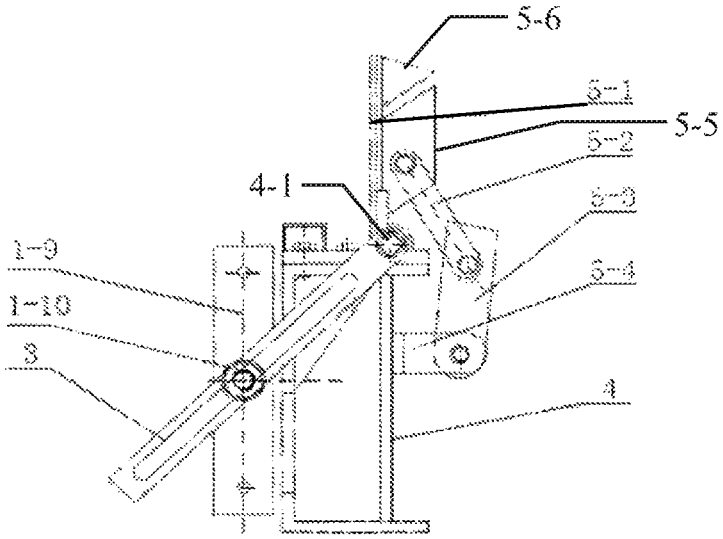
FIG. 5 is a schematic diagram of the mining elevator carrying platform in retracted state in the present invention.

The carrying method for the mining elevator carrying platform in the present invention is characterized in:

As shown in FIG. 4 and FIG. 5, when the elevator car lands, the explosion-proof motor 1-1 drives the main steel cable 1-4, the main steel cable 1-4 drives the main pulley 1-6 to rotate, and the sub-steel cable 1-7 wound on the main pulley 1-6 drives the sub-pulley 1-8 to rotate at the same time, the sliding plate 1-9 moves up and down so that the sliding rod 1-10 moves in the strip-opening sliding slot of the rotating rod 3, and thereby the rotating rod 3 and the carrying board 5-1 are driven to move circularly, and the connecting rod 5-2 drives the rocker 5-3 to rotate around the supporting bracket 5-4;

when the stop plate 1-3 on the main steel cable 1-4 hits the upper limit switch 1-2, the explosion-proof motor 1-1 stops, the end face of the rocker 5-3 abuts against the end face of the supporting plate rib 5-6 on the carrying board 5-1, and the carrying board 5-1 reaches a preset position and self-locks, so that the persons and goods can enter or exit the elevator car via the carrying board;

when the landing door and elevator car door are closed, the explosion-proof motor 1-1 drives the main steel cable 1-4 and thereby drives the main pulley 1-6 to rotate in reverse direction, and, when the stop plate 1-3 hits the lower limit switch 1-5, the explosion-proof motor 1-1 stops, and the carrying board 5-1 is retracted.

Among the drawings:

1—power system,
2—elevator car,
3—rotating rod,
4—ground sill support,
5—carrying device;
1-1—explosion-proof motor,
1-2—upper limit switch,
1-3—stop plate,
1-4—main steel cable,
1-5—lower limit switch,
1-6—main pulley,
1-7—sub-steel cable,
1-8—sub-pulley,
1-9—sliding plate,
1-10—sliding rod;
5-1—carrying board,
5-2—connecting rod,
5-3—rocker,
5-4—supporting bracket.

The invention claimed is:

1. A mining elevator carrying platform, comprising:

a power system fixed to an elevator car and a four-rod carrying device, wherein, a rotating rod connected with the power system is arranged on the carrying device;

the power system comprises:

an explosion-proof motor, an upper limit switch, a lower limit switch, and a main pulley that are fixed to a bottom beam of the elevator car in sequence, the explosion-proof motor is connected with the main pulley via a main steel cable wound on the explosion-proof motor, a stop plate is arranged on the main steel cable, the main pulley has a double cable channel, and is connected with a sub-pulley fixed to a side beam of the elevator car via a sub-steel cable, a sliding plate is arranged on the sub-steel cable, and a sliding rod is arranged on the sliding plate, the rotating rod has a strip-opening sliding slot fitted over the sliding rod designed to fixedly rotate the rotating rod relative to the sliding rod; and the carrying device comprises:

a supporting bracket fixed to a ground sill support of the elevator car and a carrying board that is fixedly connected to the rotating rod and can rotated around a rotating shaft of the ground sill support, a rocker connected with the supporting bracket is provided on a lower part of the carrying board, and a connecting rod connected with the carrying board is provided on the rocker.

2. The mining elevator carrying platform according to claim 1, wherein, strengthening ribs are provided under the carrying board and a supporting plate rib supported on the rocker is provided on an outer end of the carrying board.

3. A carrying method for the mining elevator carrying platform of claim 1, wherein:

when the elevator car lands, the explosion-proof motor drives the main steel cable, the main steel cable drives the main pulley to rotate, and the sub-steel cable wound on the main pulley drives the sub-pulley to rotate at the same time, the sliding plate moves up and down so that the sliding rod moves in the strip-opening sliding slot of the rotating rod, and thereby the rotating rod and the carrying board are driven to move circularly, and the connecting rod drives the rocker to rotate around the supporting bracket;

when the stop plate on the main steel cable hits the upper limit switch, the explosion-proof motor stops, the end face of the rocker abuts against the end face of a supporting plate rib on the carrying board, and the carrying board reaches a preset position and self-locks, so that the persons and goods can enter or exit the elevator car via the carrying board; and when the landing door and elevator car door are closed, the explosion-proof motor drives the main steel cable and thereby drives the main pulley to rotate in reverse direction, and, when the stop plate hits the lower limit switch, the explosion-proof motor stops, and the carrying board is retracted and reset.

* * * * *